US006340804B1

(12) United States Patent
Tamamoto et al.

(10) Patent No.: US 6,340,804 B1
(45) Date of Patent: Jan. 22, 2002

(54) PAPER SHEET SORTING APPARATUS AND SORTING METHOD

(75) Inventors: Junichi Tamamoto, Ibaraki-ken; Taichiro Yamashita, Tsuchiura; Kichio Nakajima, Ibaraki-ken, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/033,979

(22) Filed: Mar. 3, 1998

(30) Foreign Application Priority Data

Mar. 12, 1997 (JP) ..... 9-057364

(51) Int. Cl.[7] ..... B07C 3/14
(52) U.S. Cl. ..... 209/584; 209/900; 209/583
(58) Field of Search ..... 209/584, 900, 209/583, 587, 546, 547, 569

(56) References Cited

U.S. PATENT DOCUMENTS

| | | | | | |
|---|---|---|---|---|---|
| 3,889,811 | A | * | 6/1975 | Yoshimura | 209/549 |
| 3,977,533 | A | | 8/1976 | Hills et al. | |
| 4,307,293 | A | * | 12/1981 | Lazaarotti et al. | 235/462 |
| 4,632,252 | A | * | 12/1986 | Haruki et al. | 209/546 |
| 4,736,441 | A | * | 4/1988 | Hirose et al. | 382/101 |
| 5,119,954 | A | * | 6/1992 | Svyatsky et al. | 209/584 |
| 5,431,288 | A | * | 7/1995 | Nishijima et al. | 209/584 |
| 5,790,429 | A | * | 8/1998 | Baker et al. | 364/528.39 |
| 5,887,072 | A | * | 3/1999 | Bashomatsu et al. | 382/101 |
| 5,990,438 | A | * | 11/1999 | Yamashita et al. | 209/584 |
| 5,998,752 | A | * | 12/1999 | Barton et al. | 209/583 |
| 6,023,034 | A | * | 2/2000 | Nakajima et al. | 209/584 |

FOREIGN PATENT DOCUMENTS

| | | | | |
|---|---|---|---|---|
| CA | 2191976 | | 12/1995 | |
| EP | 0065715 | * | 12/1982 | 209/900 |
| EP | 0298769 | * | 1/1989 | 209/900 |
| JP | 406121967 | * | 5/1994 | 209/584 |
| SU | 1040510 | * | 1/1984 | 209/900 |

* cited by examiner

*Primary Examiner*—Donald P. Walsh
*Assistant Examiner*—Daniel K Schlak
(74) *Attorney, Agent, or Firm*—Antonelli, Terry, Stout & Kraus, LLP

(57) ABSTRACT

A paper sheet sorting apparatus comprising a device for reading the information recorded in paper sheets and a device for sorting the paper sheets in accordance with the information thus read, is disclosed. The load of recognizing the information is detected by a load detector. In accordance with the load detected by the load detector, the interval between the paper sheets supplied or the speed at which the paper sheets are transported is changed. In this way, the interval of the papers sheets entering the reading device is changed. The number of paper sheets having the information that cannot be recognized and hence cannot be sorted is reduced, while at the same time improving the processing speed.

31 Claims, 5 Drawing Sheets

PAPER SHEET SORTING APPARATUS AND SORTING METHOD

BACKGROUND OF THE INVENTION

1. Field of the Invention

The present invention relates to a paper sheet sorting apparatus such as a letter sorter for sorting letters or the like mails in accordance with addresses thereof, or more in particular to a paper sheet sorting apparatus for controlling the interval of supplied letters in accordance with the information amount of the letters to be processed.

2. Description of the Related Art

A letter sorter will be explained as an example of the paper sheet sorting apparatus. In the letter sorter, letters supplied one by one from a supply means are transported to a deposit means by a transport means. In the process, the information on the hardness and shape of the letters and the sorting information such as the address are fetched, and the letters are introduced to a predetermined deposit means accordance with the result of processing the information.

The information processing speed is one of stumbling blocks to increasing the number of letters capable of being processed in a unit time by the letter sorter (hereinafter referred to as "the processing speed"). Especially, the character recognition for reading an address is a time-consuming process. Letters have addresses, some printed in characters and others handwritten. Since different users have different characteristics, characters of handwritten addresses are more difficult and require longer time to recognize than those of printed addresses.

As disclosed in JP-A-63-143132, for example, some conventional letter sorters can change the interval of letters supplied according to the size of the letters involved. According to the prior art, the interval of letters supplied can be changed according to the size of the letters, but cannot be changed according to the load of information to be processed. In the case where an address is printed in characters, the recognition is accomplished with a margin. In other words, the performance of the character recognition means is not fully utilized. In the case where an address of a letter is handwritten, on the other hand, the performance of the character recognition means may be exceeded since the address may not be recognized. As described above, with the conventional letter sorters, the interval at which letters are supplied cannot be changed according to the information load to be processed. The problem is posed that the performance of the character recognition means cannot be effectively utilized or the address cannot be read and sorted successfully.

SUMMARY OF THE INVENTION

Accordingly, the object of the present invention is to improve the processing speed of a paper sheet sorting apparatus by making the most of the information processing means such as a character recognition means.

According to the present invention, in order to solve the above-mentioned problems, there is provided a paper sheet sorting apparatus comprising at least a supply means for supplying paper sheets one by one, a supply control means for controlling the supply means, an information acquisition means for acquiring information on the paper sheets, an information processing means for processing the information acquired by the information acquisition means, a deposit means for depositing the paper sheets processed by the information processing means, a distribution means for distributing the paper sheets processed by the information processing means among predetermined ones of the deposit means, a transport means for transporting the paper sheets from the supply means to the deposit means, a load measuring means for measuring the amount of the load to be processed by the information processing means and a transfer means for transferring the load measured by the load measuring means to the supply control means.

DESCRIPTION OF THE PREFERRED EMBODIMENTS

Figure 1:
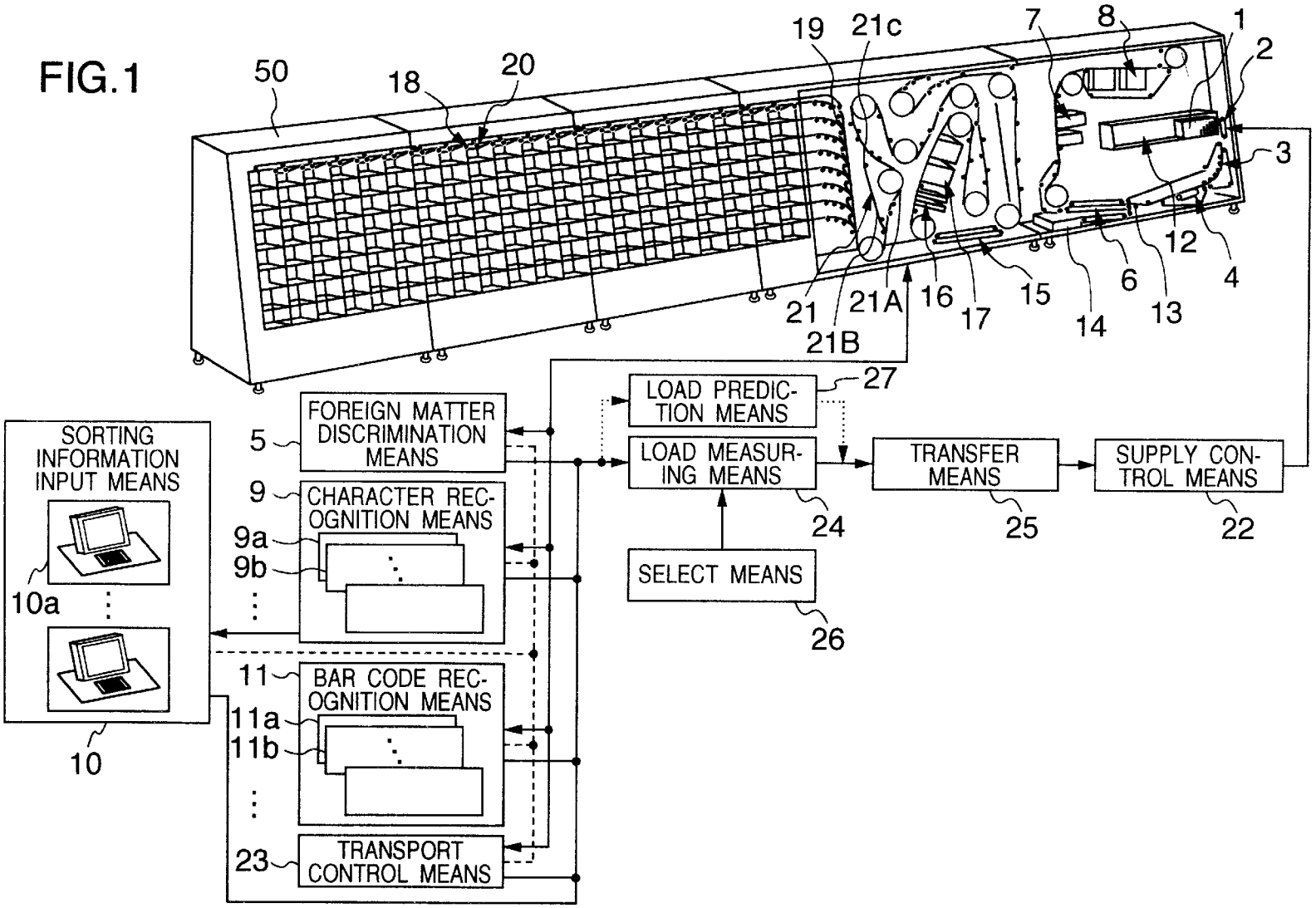
FIG. 1 is a schematic diagram showing a configuration of a letter sorter according to an embodiment of the present invention.

FIG. 1 is a schematic diagram showing a letter sorter constituting a paper sheet sorting apparatus according to an embodiment of the present invention. Paper sheets handled in the apparatus according to this embodiment mainly include mails of predetermined size such as post cards and envelopes.

A letter sorter 50 shown in FIG. 1 reads the sorting information such as an address or a bar code written on letters 1 and processes the letter in accordance with the sorting information.

First, each component element of the letter sorter 50 will be explained.

A supply means 2 is for supplying letters 1 one by one sequentially. For example, the letters 1 are attracted to a belt under a negative pressure, moved onto the belt, and sequentially supplied one by one into the letter sorter.

A transport means 3 transports the letters 1. This transport means 3 includes, for example, a pair of belts moving in opposed relationship to each other for holding and transporting the letters 1.

A foreign matter detection means 4 is for measuring the geometric information of the letters 1, and a foreign matter discrimination means 5 receives the information from the foreign matter detection means 4 and discriminates the letters that cannot be handled in the letter sorter 50. An improper size or hardness of the letters 1, or a situation in which two or more letters supplied at a time, is discriminated as an abnormal condition.

A first positioning means 6 is for correcting the position of the letters 1 and a character reading means is for reading the addresses written on the letters 1 as image information. A bar code reading means 8 is for reading any address bar code printed on the letters 1 as image information. The first positioning means 6 is located upstream of the character reading means 7 and the bar code reading means 9 for setting the letters in position thereby to improve the reading accuracy.

The character recognition means 9, on the other hand, receives the image information obtained by the character reading means 7 and retrieves the sorting information by recognizing the characters from the particular image information. In the process, in order to process a plurality of the letters 1 concurrently, the character recognition means 9 includes a plurality of recognition units 9*a*, 9*b*, and so forth.

A sorting information input means 10 processes the letters that cannot be recognized by the character recognition means 9. In this sorting information on input means 10, for example, the operator viewing the image inputs the sorting information by key entry or the like. A plurality of the sorting information input units 10*a*, 10*b*, and so forth can be provided to process the letters concurrently.

A bar code recognition means 11 receives the image information obtained by the bar code reading means 8, and recognizes the bar code from the image information thereby to retrieve the sorting information. In order to process a plurality of letters 1 concurrently, the bar code recognition means 11 includes a plurality of recognition units 11*a*, 11*b*, and so forth.

A hopper 12 is for transporting the letters 1 stacked along the thickness thereof to the supply means 2.

A first distribution means 13 is for distributing the letters and a reject-deposit means 14 is for depositing the letters rejected. The letters 1 that have been judged as abnormal by the foreign matter discrimination means 5 based on the information from the foreign matter detection means 4 are not sorted but changed in the direction of transportation by the first distribution means 13 and led to the reject-deposit means 14.

A second positioning means 15 is for positioning the letters. A bar code printing means 16 is for printing a bar code on the letters 1 not printed with any bar code. A second positioning means 15, which is located upstream of the bar code printing means 16, sets the letters 1 in position, and a bar code is printed on them in the bar code printing means 16.

A bar code checking means 17 is for checking that a bar code has been normally printed.

A letter deposit means 18 is for depositing the letters 1, a second distribution means 19 is for distributing the letters 1 into stages, and a third distribution means 20 is for distributing the letters 1 among a plurality of predetermined slots of the deposit means 18. The letters 1 are sorted into a predetermined slot of the deposit means 18 by switching between the second distribution means 19 and the third distribution means 20 in accordance with the sorting information obtained by the information processing means including the character recognition means 9, the sorting information input means 10 and the bar code recognition means 11.

An overlap means 21 is configured of two transport paths 21A, 21B having different lengths and an overlap distribution means 21C. Letters entering the latter deposit means 18 at short intervals may bump each other and cause a jam. In view of this, each pair of letters are laid one on the other in advance so as to prevent them from bumping each other in the letter deposit means 18. In the case where the transport path 21A is shorter than the transport path 21B, for example, two letters can be laid one on the other by leading the first letter to the transport path 21B and the second letter to the transport path 21A.

A supply control means 22 is for controlling the supply means 2. The supply control means 22 controls the operation of the supply means 2 and thereby adjusts the interval of the letters 1 supplied.

A transport control means 23 is for controlling the first distribution means 13, the second distribution means 19, the third distribution means 20 and the overlap distribution means 21C and for transporting the letters 1 to a predetermined slot deposit means 18 or the reject-deposit means 14 in accordance with the sorting information obtained by the character recognition means 9 or the bar code recognition means 11 and the judgment at the foreign matter discrimination means 5.

A load measuring means 24 is for measuring the amount of the load on the information processing means for processing the information of the letters 1. In the letter sorter 50, the information processing means for processing the information of the letters 1 includes the foreign matter discrimination means 5, the character recognition means 9, the sorting information input means 10, the bar code recognition means 11 and the transport control means 23.

A transfer means 25 is for transmitting the load measured by the load measuring means 24 to the supply control means 22.

A select means 26, on the other hand, is for selecting an object of which the load is measured at the load measuring means 24.

Now, explanation will be made about an example process of sorting the letters 1 by the letter sorter 50. Assume that the select means 26 selects the character recognition means 9 alone as an object of load measurement. Also, assume that an address is written in characters but no bar code is printed on the letters 1.

First, the letters 1 placed in the hopper 12 are supplied one by one from the supply means 2 and transported by the transport means 3. In order to remove the letters 1 beforehand that cannot be processed by the letter sorter 50, the foreign matter detection means 4 detects the information of the geometry of the letters 1. The normality of the letters 1 is checked from this information using the foreign matter discrimination means 5.

In the case of a given letter 1 is abnormal, the abnormality thereof is reported from the foreign matter discrimination means 5 to the transport control means 23. The transport control means 23, upon receipt of the report, activates the first distribution means 13 when the letter 1 reaches the neighborhood of the first distribution means 13, and transports the particular letter 1 to the reject-deposit means 14. As a result, the abnormal letter 1 is completely processed and not subjected to the sorting.

In the case where a given letter 1 is normal, the address thereof is read by the character reading means 7. The character reading means 7 fetches the address of the letter 1 as an image, and transmits the image to the character recognition means 9. The character recognition means 9 delivers an image to a character recognition unit (say, 9*a*) and thus recognizes the address. Once the address could be recognized, the sorting information obtained from the address could be transmitted to the transport control means 23.

In the case where the address cannot be recognized, the image is transmitted to the sorting information input means 10. At the sorting information input means 10, the operator viewing the address displayed on the screen enters a corresponding sorting information by way of a keyboard or the like. Then the sorting information is transmitted to the transport control means 23.

Next, the letters 1 pass the bar code reading means 8. In the case under consideration, the letters 1 not printed with a bar code are assumed and therefore are not processed in the bar code reading means 8.

In the case where a bar code is printed, in contrast, as in the case of reading an address, the bar code is fetched as an image by the bar code reading means 8 and transmitted to the bar code recognition means 11. The sorting information is recognized in a bar code recognition unit (say, 11*a*) from the bar code, and transmitted to the transport control means 23.

In the process mentioned above, any letter 1 not printed with a bar code for which the sorting information obtained by the address read operation has been read is printed with an appropriate bar code. The second positioning means 15 sets the letter 1 in position. The bar code printing means 16 converts the sorting information into a bar code and prints the bar code. This letter 1, when sorted subsequently by the letter sorter 50, is done so by reading the bar code. The sorting information can be read more quickly and more accurately by recognizing a bar code than by recognizing a character, and thus the processing performance can be improved.

Then, the letters 1 pass through the overlap means 21. The letters, if loaded continuously in the same deposit means 18, are apt to bump each other and cause a jam in the deposit means 18. The transport control means 23, when judged that two letters are distributed continuously to the same deposit means 18, switches the-overlap distribution means 21C to lay the two letters one on the other in advance.

After that, the transport control means 23 switches the direction of transportation by the second distribution means 19 and the third distribution means 20, and thus leads the letters 1 to any one of the deposit means 18 corresponding to the sorting information.

The sorting process on the letters 1 is thus completed.

The foregoing description concerns the case in which the letters 1 are sorted one by one sequentially. Actually, however, a multiplicity of letters are processed concurrently in order to improve the performance of the letter sorter 50. By doing so, the number of letters processed per unit time (hereinafter referred to as the processing speed) can be improved.

Nevertheless, the performance of the letter sorter 50 imposes a certain upper limit on the processing speed. The upper limit is determined by the three factors described below.

First, in order not to damage the letters 1, the transport speed of the transport means 3 is desirably as low as possible. A high transport speed may sometimes damage the letters 1 suddenly coming to stop when led into the deposit means 18. Also, a high transport speed may undesirably shorten the service life of the parts (such as bearings) of the letter sorter 50. A low transport speed, on the other hand, cannot meet the requirement of a specified processing speed. This letter sorter 50 is set to a proper transport speed taking the trade-off between these factors into account.

Figure 2:
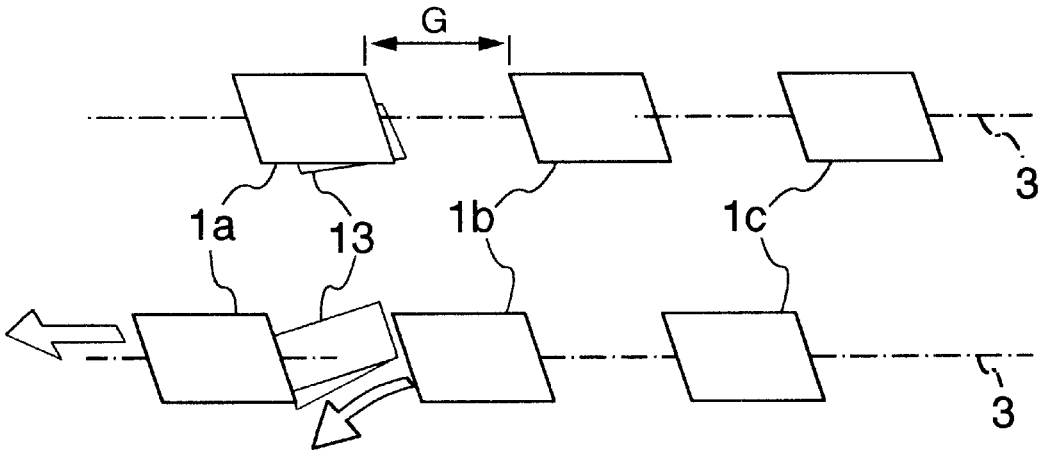
FIG. 2 is a model diagram showing the manner in which letters are distributed in the distribution means.

Secondly, in order to sort the letters 1, the direction of transportation is switched by the distribution means such as the first distribution means 13. As shown in the example of FIG. 2, the first distribution means 13 begins to operate after the leading letter 1*a* has passed therethrough and finishes the switching operation before the arrival of the succeeding letter 1*b*. The letters, therefore, are required to have not less than a predetermined interval G. In view of this, the letter sorter 50 is adjusted to secure at least the interval G between the letters 1 supplied from the supply means 2 by use of the supply control means 22.

Figure 3:
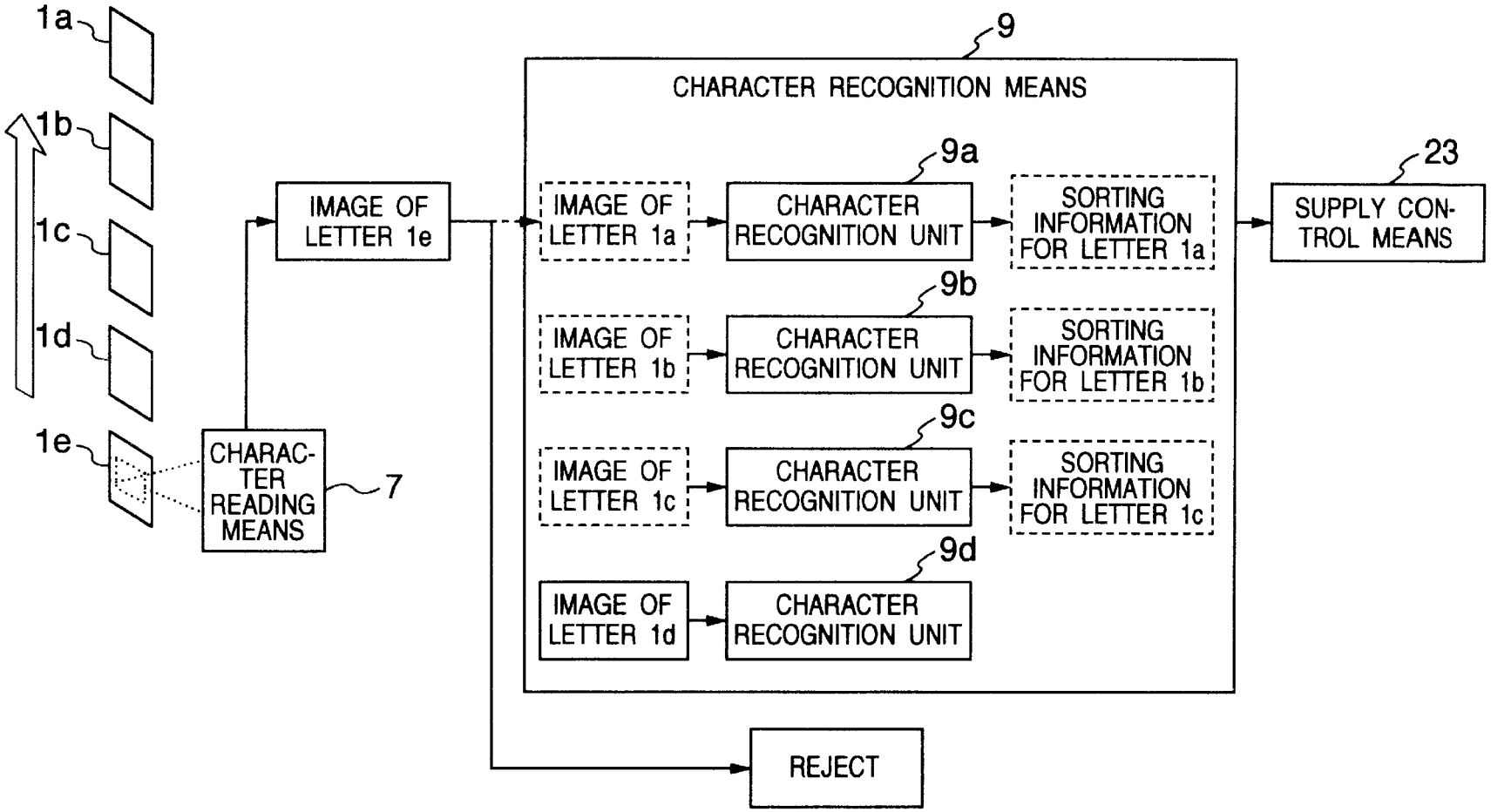
FIG. 3 is a model diagram showing the processing in the character recognition means.

Thirdly, the images of the addresses on the letters 1, as shown in FIG. 3, are distributed by the character recognition units of the character recognition means 9. However, the characters of some addresses may take a long time to recognize while the characters of other addresses may be easily recognized and processed in a short time. For example, handwritten characters are varied from one person to another in style and generally are difficult and require a long time to recognize. The characters printed in characters, on the other hand, have predetermined patterns and more definite than handwritten characters. Therefore, the recognition of printed characters is easier and requires less time.

As an example, FIG. 3 shows the case in which letters having addresses of handwritten characters and printed characters are processed by four character recognition units. In the order of supply, the image of the address of the letter 1*a* is transmitted to the character recognition unit 9*a*, and the image of the address of the letter 1*b* to the character recognition unit 9*b*. Similarly, the letter 1*c* is transmitted to the character recognition unit 9*c*, the letter 1*d* to the character recognition unit 9*d*, and so on.

The handwritten characters require about twice as much time as the printed characters to recognize (two seconds for a handwritten character, and one second for a printed character, for example). Therefore, recognition of the images of the letters 1*a* to 1*c* indicated by dashed lines is not yet complete. Thus, when the image of the address of the letter 1*e* is read, all the character recognition units are still in the process of image recognition. Thus the image of the letter 1*e* cannot be recognized and the sorting information thereof cannot be obtained, thereby making the sorting thereof impossible. Generally, the printed letters represent about 70% and the handwritten letters represent about 30% of all the letters handled. This ratio, however, is varied according to the time zone of the day and the day of the week.

The printed characters, in contrast, consume less time to-recognize than the handwritten characters. When the image of the address of the letter 1*e* has been read, the recognition of the images of the letters 1*a* to 1*c* indicated by dashed lines is already complete and the sorting information has been sent out. Consequently, the image of the letter 1*e* can be processed, and can reach the character reading means 7 at an earlier timing. Conversely, a delayed processing of the letter 1*e* may reduce the load of the character recognition unit for a lower processing speed of the letter sorter 50.

For this reason, the letter sorter 50 includes a load measuring means 24 to measure the load for recognition by the character recognition means 9. The measurement is taken, for example, of the availability of the character recognition units. As an alternative method, information on whether the image being processed represent printed characters or handwritten characters and the approximate number of characters are acquired from each character recognition unit, and the recognition load is calculated from these information. The load thus measured is transferred through the transfer means 25 to the supply control means 22. When the load is heavy, the supply control means 22 lengthens the interval between the letters 1 supplied. In the case where the load is small, on the other hand, the interval between the letters 1 supplied is shortened. In this way, a proper load is maintained and the processing speed of the letter sorter 50 can-be improved.

An example of sorting operation in this letter sorter 50 will be explained with reference to FIG. 5.

Figure 5:
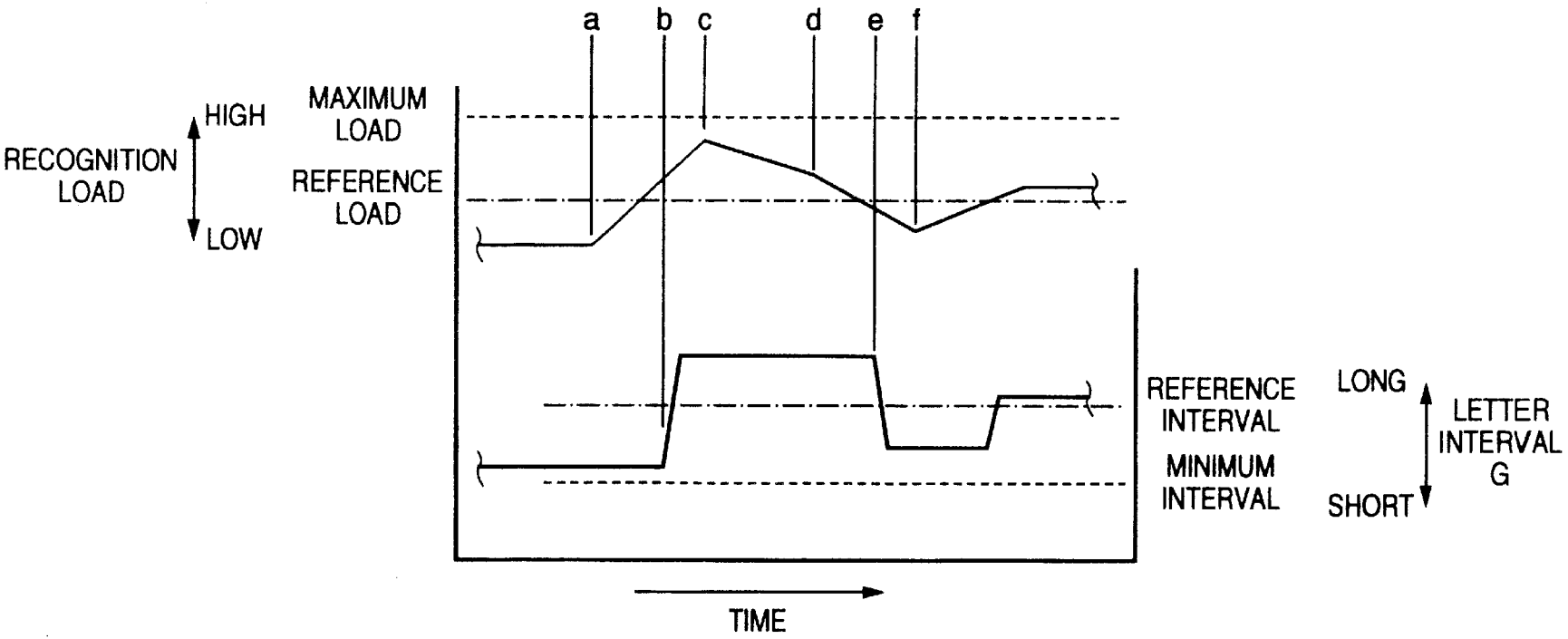
FIG. 5 is a diagram for explaining the operation when the load condition undergoes a change.

FIG. 5 shows the manner in which the letter interval G automatically changes in order for the recognition load to approach a reference load. The upper curve represents the manner in which the recognition load changes as measured by the load measuring means 24, and the lower curve shows the change of the indication of the letter interval G by the supply control means 22 characters a to f designate time points.

In terms of the load per letter, the range before a and from d to f represents letters of small recognition load (such as letters having a printed address, hereinafter referred to as the printed letters), while the range from a to d and after f represents letters of large recognition load (such as letters having a handwritten address, hereinafter referred to as the handwritten letters).

Before time point a, letters having a printed address are read, and therefore the character recognition means 9 can complete the recognition process within a comparatively short time. The recognition load measured by the load measuring means 24, therefore, is smaller than the reference load. The supply control means 22 thus controls the supply means 2 in such a manner as to shorten the letter interval G as compared with the reference interval. As a result, the processing speed of the letter sorter 50 is improved.

In the range from time point a to d, the letters having a handwritten address are read, and therefore a longer time is required for the character recognition means 9 to perform the recognition process. After time point a, therefore, the recognition load begins to increase. As soon as the recognition load exceeds a maximum load, the address cannot be recognized and the letters involved are rejected. Thus, the number of letters supplied is reduced to prevent rejection. For this purpose, the supply control means 22 controls the supply means 2 in such a manner as to increase the letter interval G from time point b.

In view of the time lag that exists between the operation of the supply means 2 and the operation of the character reading means 7, the effect of lengthening the letter interval G at time point b is not exhibited until time point c. At time point c, the recognition load begins to steadily decrease toward the reference load.

Further, the letters having a printed address are read in the range of time point d to time point f, during which the recognition load is reduced. The supply control means 22 thus shortens the letter interval G as compared with the reference interval at time point e.

As described with reference to examples above, the processing performance of the letter sorter 50 can be improved by shortening the supply interval in the case of reading letters having a small recognition load such as those having a printed address. When reading letters of large recognition load such as those having a handwritten address, in contrast, the supply interval is lengthened to reduce the number of letters rejected.

In the above-mentioned case, the object of which the load is measured is limited to the character recognition means 9 by the select means 26. The object, however, can be any or all of the means for processing the letter information including the foreign matter discrimination means 5, the sorting information input means 10, the bar code recognition means 11 and the transport control means 23.

As described above, the processing speed can be improved by adjusting the interval at which letters are supplied based on the interval required for switching the distribution means and the load of the means for processing the letter information.

Of all the objects of load measurement described above, the load on the character recognition means 9 is technically most difficult to recognize in the state of art. A configuration is desired, therefore, that reflects the load of the character recognition means 9 most significantly.

Figure 4:
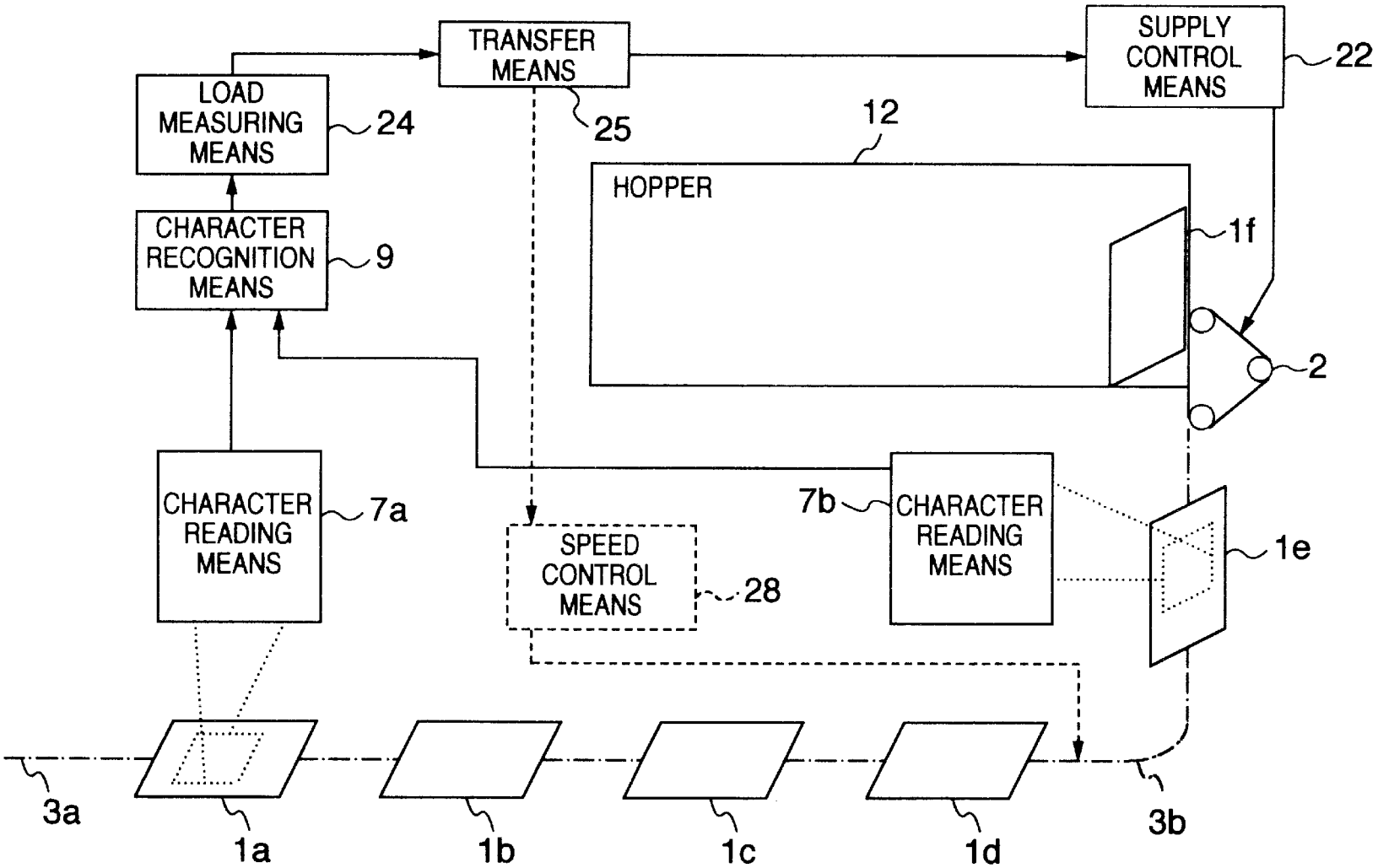
FIG. 4 is a schematic diagram of a letter sorter having a configuration partly changed.

FIG. 4 shows an example number of letters on the transport path 3 between the supply means 2 and the character reading means 7. The character reading means 7*a* is associated with the position in the case where the transport means 3 is long between the supply means 2 and the character-reading means 7, and the character reading means 7*b* represents the position in the case where the transport means 3 is short between the supply means 2 and the character reading means 7.

Assume the position of the character reading means 7*a*. FIG. 4 shows that five letters are located on the transport means 3. Also assume that the load of the character recognition means 9 is measured by the load measuring means 24 when the letter 1*a* arrives at the character reading means 7*a*. This load is reflected in the interval at which letter 1*f* is supplied but not reflected in the interval of supplying the letters 1*b* to 1*e* already placed on the transport means 3.

Assume, for example, that the letters before the letter 1*a* have an address of printed characters, and the letters including and after the letter 1*a* have a handwritten address. When the letter 1*a* having an address of handwritten characters is read, therefore, the load increases, so that the interval at which the letter 1*f* and subsequent letters are supplied is lengthened. The letters 1*b* to 1*e*, however, continue to be supplied at the original short interval, thereby further increasing the load. The result may be that the performance of the character recognition means 9 is exceeded and an address cannot be read.

At the position of the character reading means 7*b*, on the other hand, the load generated by reading the letter 1*e* is reflected in the letter 1*f*. As a result, the load increase is reduced and the performance of the character recognition means 9 is not exceeded.

The character reading means 7 thus is desirably located in the neighborhood of the supply means 2. From the viewpoint of the system configuration, however, the character reading means 7 cannot sometimes be installed in the neighborhood of the supply means 2. In such a case, as shown by dashed line in FIG. 1, a load prediction means 27 is added. By doing so, the load is predicted when the letter 1*f* located in the supply means 2 reaches the character reading means 7 thereby making it possible to determine the interval at which letters are supplied. As an example method, an average recognition time is determined for several letters recognized before the letter 1*a* by the character recognition means 9. This average recognition time is used to determine the number of letters of which the images are completely recognized in the character recognition means 9 before the letter 1*f* reaches the character reading means 7. Also, the number of letters existing between the supply means 2 and the character reading means 7 is determined. This number of letters can be easily determined since the letter position is controlled by the transport control means 23. The change in image amount is multiplied by the average recognition time to predict the load.

An example of the load prediction means 24 is realized by a method of predicting the recognition load from the size difference of the address space of letters. The larger the address space, the greater the amount of image information and a longer time is required for detecting a character from the particular image. The envelope having the largest specified size, for example, has an address space of 120 mm×235 mm, which is about 1.9 times as large as the size 100 mm×148 mm of the address space of the post card. The time required to detect characters indicating an address on a letter, therefore, is about twice as long as that for the postcard.

Consequently, the load can be predicted also at a time point when the size of the address space of the letter is detected by the foreign matter detection means 4, for example.

Another method for attaining a similar purpose consists in adjusting the timing of the letter 1 reaching the character reading means 7 by changing the transport speed of the letter 1 and thus maintaining a proper load value. For this purpose, a variable speed transport means 3*b* having a variable speed and a speed control means 28 for controlling the transport speed of the variable speed transport means 3*b* are interposed between the supply means 2 and the character reading means 7.

The speed control means 28 reduces the speed of the variable speed transport means 3*b* when the load is heavy and thereby retards the timing of the letters reaching the character reading means 7. The character recognition means 9 can thus take time to proceed with the recognition of characters before receiving the next image. When the load is small, the speed of the variable speed transport means 3*b* is increased thereby to advance the timing at which the letters arrive at the character reading means 7. As a consequence, the image can be transmitted to an idle character recognition unit in the character recognition means 9 for an improved processing performance.

An example is shown in FIG. 4. In FIG. 4, the load of the character recognition means 9 undergoes a change as the result of the character reading means 7 having read the letter 1*a*. The load thus changed is measured by the load measuring means 24, and transmitted through the transfer means 25 to the supply control means 22 and the speed control means 28. The supply control means 22, as described above, changes the interval of the letter 1*f* supplied by the supply means 2.

In this example, the load of the letter 1*a* can be reflected also in the letter 1*b* by changing the transport speed of the variable speed transport means 3*b* by the speed control means 28.

Also, the variable speed transport means 3*b*, which has been interposed between the supply means 2 and the character reading means 7 in the above-mentioned example, can alternatively be located downstream of the character reading means 7 as far as the character reading means 7 is capable of following the changing transport speed.

The description is made above with reference to a letter sorter for handling letters as an object to be sorted. The present invention, however, is also applicable to any sorting apparatus in which processed the information of paper sheets and changes the sorting mode on the basis of the result of processing the information.

According to the present invention, the interval at which paper sheets are supplied can be changed according to the load of processing the information on the paper sheets. Therefore, the amount of paper sheets incapable of sorting can be reduced while at the same time improving the processing speed.

What is claimed is:

1. A paper sheet sorting apparatus comprising:

supply means for supplying paper sheets one by one;

supply control means connected with said supply means for controlling a supply interval of said paper sheets;

information acquisition means for acquiring information on said paper sheets;

information processing means for processing the information acquired by said information acquisition means to determine transport destinations of said paper sheets;

deposit means for depositing said paper sheets processed by said information processing means;

distribution means for distributing said paper sheets to ones of said deposit means on the basis of the transport destination determined by said information processing means;

transport means for transporting said paper sheets from said supply means to said deposit means; and load measuring means for measuring a processing load necessary for processing the information on said paper sheets by said information processing means;

wherein said supply control means controls operation of said supply means to adjust the supply interval of said paper sheets in accordance with the processing load measured by said load measuring means.

2. A paper sheet sorting apparatus according to claim 1, wherein said processing load includes the time required for character recognition, bar code recognition and the amount of the paper sheets processed.

3. A paper sheet sorting apparatus according to claim 1, wherein said information processing means comprises:

foreign matter detection means for measuring geometric information of each of said paper sheets;

foreign matter discrimination means for determining whether each of said paper sheets is abnormal for ejection;

character reading means for reading addresses written on said paper sheets as image information;

character recognition means for recognizing characters from said image information;

sorting information input means for enabling an operator to input sorting information to process said paper sheets;

bar code reading means for reading bar codes written on said paper sheets as image information;

bar code recognition means for recognizing said bar codes from said image information; and transport control means for controlling transportation of said paper sheets to predetermined slots of a depository in accordance with one of said sorting information obtained from said sorting information input means and said image information obtained from said character recognition means and said bar code recognition means.

4. A paper sheet sorting apparatus according to claim 1, further comprising:

bar code printing means for printing a bar code on a selected one of said paper sheets not printed with any bar code; and bar code checking means for checking whether a bar code is normally printed on said selected one of said paper sheets.

5. A paper sheet sorting apparatus according to claim 4, wherein said character recognition means comprises a plurality of recognition units each recognizing characters from a corresponding one of said paper sheets.

6. A paper sheet sorting apparatus according to claim 1, further comprising select means for selecting said character recognition means as an object of which the processing load is measured by said load measuring means.

7. A paper sheet sorting apparatus according to claim 1, wherein said supply control means controls to increase the supply interval of the paper sheets by said supply means when the processing load measured by said load measuring means is larger than a predetermined processing load and to reduce the supply interval of the paper sheets by said supply means when the processing load measured by said load measuring means is smaller than the predetermined processing load.

8. A paper sheet sorting apparatus according to claim 1, wherein said load measuring means measures a time necessary for recognizing information recorded on said paper sheets, and wherein said supply control means controls said supply means to widen the supply interval of said paper sheets when the number of paper sheets whose information is recognized with taking time exceeding a predetermined time exceeds a predetermined value.

9. A paper sheet sorting apparatus according to claim 1, wherein:

said information acquisition means is image acquisition means for acquiring images on address side surfaces of said paper sheets;

said information processing means is character recognition means for recognizing characters in the image of the address side surface; and said load measuring means is means for measuring the processing load of said character recognition means.

10. A paper sheet sorting apparatus comprising;

supply means for supplying paper sheets one by one;

supply control means connected with said supply means for controlling a supply interval of said paper sheets;

a plurality of information acquisition means for acquiring information on said paper sheets;

information processing means for processing the information acquired by said information acquisition means to determine transport destinations of said paper sheets;

deposit means for depositing said paper sheets processed by said information processing means;

distribution means for distributing said paper sheets to ones of said deposit means on the basis of the transport destinations determined by said information processing means;

transport means for transporting said paper sheets from said supply means to said deposit means;

select means for selecting one of said information acquisition means for measuring a processing load; and load measuring means for measuring the processing load of a selected one of said information processing means;

wherein said supply control means controls operation of said supply means to adjust the supply interval of said paper sheets in accordance with the processing load measured by said load measuring means.

11. A paper sheet sorting apparatus according to claim 10, wherein said information processing means comprises:

foreign matter detection means for measuring geometric information of each of said paper sheets;

foreign matter discrimination means for determining whether each of said paper sheets is abnormal for ejection;

character reading means for reading addresses written on said paper sheets as image information;

character recognition means for recognizing characters from said image information;

sorting information input means for enabling an operator to input sorting information to process said paper sheets;

bar code reading means for reading bar codes written on said paper sheets as image information;

bar code recognition means for recognizing said bar codes from said image information; and transport control means for controlling transportation of said paper sheets to predetermined slots of a depository in accordance with one of said sorting information obtained from said sorting information input means and said image information obtained from said character recognition means and said bar code recognition means.

12. A paper sheet sorting apparatus according to claim 4, further comprising:

bar code printing means for printing a bar code on a selected one of said paper sheets not printed with any bar code; and bar code checking means for checking whether a bar code is normally printed on said selected one of said paper sheets.

13. A paper sheet sorting apparatus according to claim 12, wherein said character recognition means comprises a plurality of recognition units each recognizing characters from a corresponding one of said paper sheets.

14. A paper sheet sorting apparatus according to claim 10, wherein said supply control means controls to increase the supply interval of the paper sheets by said supply means when the processing load measured by said load measuring means is larger than a predetermined processing load and to reduce the supply interval of the paper sheets by said supply means when the processing load measured by said load measuring means is smaller than the predetermined processing load.

15. A paper sheet sorting apparatus according to claim 10, wherein said load measuring means measures a time necessary for recognizing information recorded on said paper sheets, and wherein said supply control means controls said supply means to widen the supply interval of said paper sheets when the number of paper sheets whose information is recognized with taking time exceeding a predetermined time exceeds a predetermined value.

16. A paper sheet sorting apparatus according to claim 10, wherein:

said information acquisition means is image-acquisition means for acquiring images on an address side surfaces of said paper sheets;

said information processing means is character-recognition means for recognizing characters in the image of the address side surface; and said load measuring means is means for measuring the processing load of said character recognition means.

17. A paper sheet sorting apparatus comprising:

supply means for supplying paper sheets one by one;

supply control means connected with said supply means for controlling a supply interval of said paper sheets;

information acquisition means for acquiring information on said paper sheets;

information processing means for processing the information acquired by said information acquisition means to determine transport destinations of said paper sheets;

deposit means for depositing said paper sheets processed by said information processing means;

distribution means for distributing said paper sheets to ones of said deposit means on the basis of the transport destinations determined by said information processing means;

transport means for transporting said paper sheets from said supply means to said deposit means;

load measuring means for measuring a processing load necessary for processing the information on said paper sheets by said information processing means; and load prediction means for predicting the processing load necessary for processing the information on said paper sheets by said information processing means;

wherein said supply control means controls operation of said supply means to adjust the supply interval of said paper sheets in accordance with the processing load estimated by said load measuring means and said load prediction means.

18. A paper sheet sorting apparatus according to claim 12, wherein said information processing means comprises:

foreign matter detection means for measuring geometric information of each of said paper sheets;

foreign matter discrimination means for determining whether each of said paper sheets is abnormal for ejection;

character reading means for reading addresses written on said paper sheets as image information;

character recognition means for recognizing characters from said image information;

sorting information input means for enabling an operator to input sorting information to process said paper sheets;

bar code reading means for reading bar codes written on said paper sheets as image information;

bar code recognition means for recognizing said bar codes from said image information; and transport control means for controlling transportation of said paper sheets to predetermined slots of a depository in accordance with one of said sorting information obtained from said sorting information input means and said image information obtained from said character recognition means and said bar code recognition means.

19. A paper sheet sorting apparatus according to claim 18, further comprising:

bar code printing means for printing a bar code on a selected one of said paper sheets not printed with any bar code; and bar code checking means for checking whether a bar code is normally printed on said selected one of said paper sheets.

20. A paper sheet sorting apparatus according to claim 19, wherein said character recognition means comprises a plurality of recognition units each recognizing characters from a corresponding one of said paper sheets.

21. A paper sheet sorting apparatus according to claim 17, wherein said supply control means controls said supply means to increase the supply interval of the paper sheets when the processing load estimated by said load measuring means and by said load prediction means is larger than a predetermined processing load and to reduce the supply interval of the paper sheets when the processing load estimated by said load measuring means and by said load prediction means is smaller than the predetermined processing load.

22. A paper sheet sorting apparatus according to claim 21, wherein:

said information acquisition means is image acquisition means for acquiring images on an address side surfaces of said paper sheets;

said information processing means is character recognition means for recognizing characters in the image of the address side surface;

said load measuring means is means for measuring the processing load of said character recognition means; and said load prediction means is means for predicting the processing load on the basis of sizes of the address side surface of said paper sheets.

23. A paper sheet sorting apparatus according to claim 17, wherein:

said information acquisition means is image acquisition means for acquiring images on an address side surfaces of said paper sheets;

said information processing means is character recognition means for recognizing characters in the image of the address side surface; and said load measuring means is means for measuring the processing load of said character recognition means.

24. A paper sheet sorting apparatus comprising:

supply means for supplying paper sheets one by one;

supply control means connected with said supply means for controlling a supply interval of said paper sheets;

information acquisition means for acquiring information on said paper sheets;

information processing means for processing the information acquired by said information acquisition means to determine transport destinations of said paper sheets;

deposit means for depositing said paper sheets processed by said information processing means;

distribution means for distributing said paper sheets to ones of said deposit means on the basis of the transport destinations determined by said information processing means;

transport means for transporting said paper sheets from said supply means to said deposit means;

load measuring means for measuring a processing load necessary for processing the information on said paper sheets be said information processing means;

variable speed transport means variable in transport speed disposed on the transport path between said supply means and said information acquisition means; and speed control means for controlling the transport speed of said variable speed transport means;

wherein said supply control means controls operation of said supply means to adjust the supply interval of said paper sheets to be supplied in accordance with the processing load measured by load measuring means, and wherein said speed control means controls operation of said variable speed transport means to adjust the transport speed of said paper sheets in accordance with the processing load measured by said load measuring means.

25. A paper sheet sorting apparatus according to claim 24, wherein said information processing means comprises:

foreign matter detection means for measuring geometric information of each of said paper sheets;

foreign matter discrimination means for determining whether each of said paper sheets is abnormal for ejection;

character reading means for reading addresses written on said paper sheets as image information;

character recognition means for recognizing characters from said image information;

sorting information input means for enabling an operator to input sorting information to process said paper sheets;

bar code reading means for reading bar codes written on said paper sheets as image information;

bar code recognition means for recognizing said bar codes from said image information; and transport control means for controlling transportation of said paper sheets to predetermined slots of a depository in accordance with one of said sorting information obtained from said sorting information input means and said image information obtained from said character recognition means and said bar code recognition means.

26. A paper sheet sorting apparatus according to claim 25, further comprising:

bar code printing means for printing a bar code on a selected one of said paper sheets not printed with any bar code; and bar code checking means for checking whether a bar code is normally printed on said selected one of said paper sheets.

27. A paper sheet sorting apparatus according to claim 26, wherein said character recognition means comprises a plurality of recognition units each recognizing characters from a corresponding one of said paper sheets.

28. A paper sheet sorting apparatus according to claim 24, wherein, when the processing load measured by said load measuring means is larger than a predetermined processing load, said supply control means controls said supply means to increase the supply interval of the paper sheets and said speed control means controls to reduce the transport speed of said variable speed transport means, and wherein, when the processing load measured by said load measuring means is smaller than the predetermined processing load, said supply control means controls said supply means to reduce the supply interval of the paper sheets and said speed control means controls to increase the transport speed of said variable speed transport means.

29. A paper sheet sorting apparatus according to claim 24, wherein:

said information acquisition means is image acquisition means for acquiring images on an address side surfaces of said paper sheets;

said information processing means is character recognition means for recognizing characters in the image of the address side surface; and said load measuring means is means for measuring the processing load of said character recognition means.

30. A paper sheet sorting apparatus comprising:

supply means for supplying paper sheets one by one;

supply control means for controlling a supply interval of individual sheets of paper from said supply means;

information acquisition means including character recognition means for acquiring information on individual sheets of paper;

information processing means for processing the information acquired by the information acquisition means to determine transport destinations of different sheets of paper;

deposit means for depositing said individual sheets of paper processed by said information processing means;

distribution means for distributing said individual sheets of paper to ones of said deposit means on the basis of the transport destination determined by said information processing means;

transport means for transporting said individual sheets of paper from said supply means to said deposit means;

load measuring means for measuring a processing load necessary for processing information on said individual sheets of paper; and transfer means for transferring the processing load measured by said load measuring means to said supply control means to adjust the supply interval of individual sheets of paper.

31. A paper sheet sorting apparatus, comprising:

supply means for supplying paper sheets one by one;

supply control means for controlling operation of said supply means;

information acquisition means for acquiring information on said paper sheets;

information processing means for processing the information acquired by said information acquisition means;

deposit means for depositing said paper sheets processed by said information processing means;

distribution means for distributing said paper sheets processed by said information processing means to a predetermine one of said deposit means;

transport means for transporting said paper sheets from said supply means to said deposit means; and load measuring means for measuring a processing load of said information processing means;

wherein said supply control means controls operation of said supply means in accordance with an output of said load measuring means, wherein said load measuring means measures a time necessary for recognizing information recorded on said paper sheets, and wherein said supply control means controls said supply means to widen a supply interval of said paper sheets when the number of paper sheets whose the information is recognized with taking time exceeding a predetermined time exceeds a predetermined value.

* * * * *